US006106349A

United States Patent [19]

Motosko

[11] Patent Number: 6,106,349

[45] Date of Patent: Aug. 22, 2000

[54] INFLATABLE FLOTATION DEVICE

[76] Inventor: Stephen Motosko, 3535 LaPaloma Ave., Sarasota, Fla. 34242

[21] Appl. No.: 09/411,613

[22] Filed: Oct. 1, 1999

[51] Int. Cl.[7] ..... B63C 9/28

[52] U.S. Cl. ..... 441/129; 446/220

[58] Field of Search ..... 441/1, 6, 80, 88, 441/129, 136; 446/220, 221

[56] References Cited

U.S. PATENT DOCUMENTS

| | | | |
|---|---|---|---|
| 3,676,276 | 7/1972 | Hirshen et al. | 446/220 |
| 3,992,739 | 11/1976 | Stevens et al. . | |
| 4,472,225 | 9/1984 | Bimpson . | |
| 5,685,752 | 11/1997 | Fulton, Jr. . | |
| 5,779,512 | 7/1998 | Rupert . | |

*Primary Examiner*—Jesus D. Sotelo
*Attorney, Agent, or Firm*—Charles J. Prescott

[57] ABSTRACT

An elongated inflatable tubular device which is freely bendable, when inflated, in multiple directions about the longitudinal axis of the device. The device includes an elongated tubular member sealed at each end thereof to form a sealed inflatable air chamber. Spaced apart bendable folds are each formed generally transversely across said tubular member by attachment of one or more opposite points or areas of the side wall of the tubular member along a portion of the length of, and defining each fold. Air within said tubular member is thus free to flow past each fold to balance air pressure within the tubular member during inflation, deflation and bending thereof. The folds are rotationally oriented differently one to another, when viewed along a longitudinal axis of the tubular member, thereby allowing the flotation device to be freely bendable in multiple directions about the longitudinal axis. In the preferred embodiment, the ends of the device are cooperatively shaped, one end thereof having a central aperture formed therethrough sized to pliably receive the other end of the device for releasable retention therebetween and forming the device into a flexible ring.

6 Claims, 5 Drawing Sheets

INFLATABLE FLOTATION DEVICE

BACKGROUND OF THE INVENTION

SCOPE OF INVENTION

This invention relates generally to inflatable tubes formed of flexible material such as plastic, polymer coated fabric material, vinyl and other materials which are air tight, and more particularly to a flotation device formed of such a tubular member having multiple folds spaced apart along the length of the flotation device to facilitate ease of bending compliance to supported body contours.

PRIOR ART

One flotation device that has become quite popular in swimming pools and other swimming areas is a "pool noodle" which is an elongated member formed of flexible Styrofoam and other closed cell foam material. These pool noodles are typically five to six feet in length having a diameter of approximately three to six inches and are quite enjoyable for swimming pool play and simply floating relaxation in water. However, although they are bendable from a relaxed straight configuration with some stiffness with respect to the foam construction material itself, these swimming pool play and flotation devices require some continuing effort to maintain them in a curved, behind the neck or under the torso in-use position which may be uncomfortable and may become tiring to the arms.

In U.S. Pat. No. 4,472,225, Bimpson teaches an inflatable tube such as a buoyancy tube for inflatable life rafts, particularly focusing on a method of imparting a permanent sealed bend into the tubular structure which is leak proof and economical to form without additional cutting or adding of material to effect a permanent bend in the tube.

Rupert, in U.S. Pat. No. 5,779,512, has disclosed a flotation device formed of smaller and larger concentrically attached buoyancy tubes. While adding buoyancy, this arrangement lends itself well to fitting the device over the head of the user around the neck area and yet accommodating the broader width of the user's shoulders.

A compressible and expandable flotation device shown in U.S. Pat. No. 5,685,752 invented by Holton which is compressible and expandable in accordion fashion, includes internal structure which allows the device to be self-inflating when the ends are moved apart and brought back together in repeated fashion. The water safety device invented by Stevens shown in U.S. Pat. No. 3,992,739 is formed of an elongated closed tubular member having a longitudinal handle strap along a length thereof for a victim to grasp while being pulled to shore by another person on shore or in a boat.

The present invention overcomes the stiffness or resistance to bending of the pool noodles by providing a plurality of folds formed transversely across the inflatable tubular member with the spaced apart folds oriented rotationally with respect to the longitudinal axis of the device in multiple directions so that the tubular member may be freely bent or wrapped around the body in complex arcuate fashion to better accommodate and support the various portions of the body beneath which the device is positioned.

BRIEF SUMMARY OF THE INVENTION

This invention is directed to an elongated inflatable tubular device which is freely bendable, when inflated in multiple directions about the longitudinal axis of the device. The device includes an elongated tubular member sealed at each end thereof to form a sealed inflatable air chamber. Spaced apart bendable folds are each formed generally transversely across said tubular member by attachment of one or more opposite points or areas of the side wall of the tubular member along a portion of the length of, and defining each fold thereby allowing air within said tubular member to freely flow past each fold to balance air pressure within the tubular member during inflation, deflation and bending during use thereof. The folds are rotationally oriented differently one to another, when viewed along a longitudinal axis of the tubular member, thereby allowing the flotation device to be freely bendable in multiple directions about its longitudinal axis.

It is therefore an object of this invention to provide an elongated tubular flotation device or inflatable tube having multiple spaced apart folds formed across or transversely to the length of the device and angularly or rotationally oriented with respect to the longitudinal axis of the tubular member in different directions to facilitate free bending movement about each of the folds to better accommodate the complex curvature of the supported body and torso.

It is another object of this invention to provide an inflatable flotation device which has substantially more compliance and comfort to body configuration and support thereof when swimming as compared to conventional stiffer pool noodles.

It is still another object of this invention to provide an elongated air-filled tubular flotation device having multiple permanent spaced folds formed transversely across the tubular member which allow for free passage of air within the device for ease of filling and deflation and pressure balancing between adjacent air chambers defined by adjacent folds.

In accordance with these and other objects which will become apparent hereinafter, the instant invention will now be described with reference to the accompanying drawings.

DETAILED DESCRIPTION OF THE INVENTION

Figure 1:
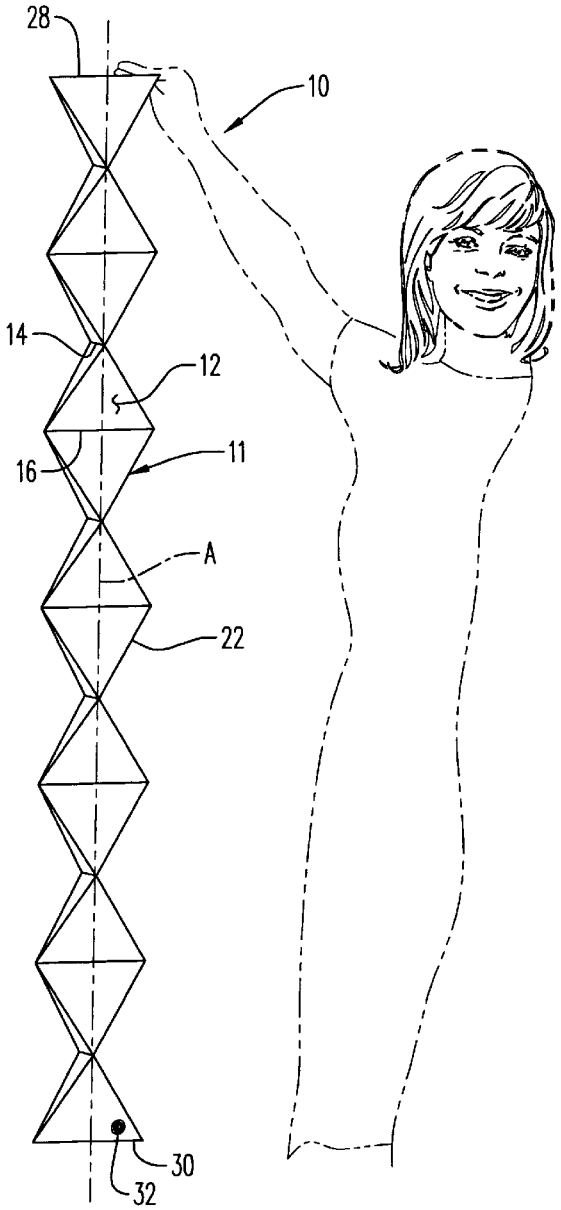
FIG. 1 is a side elevation view of one embodiment of the invention.
Figure 2:
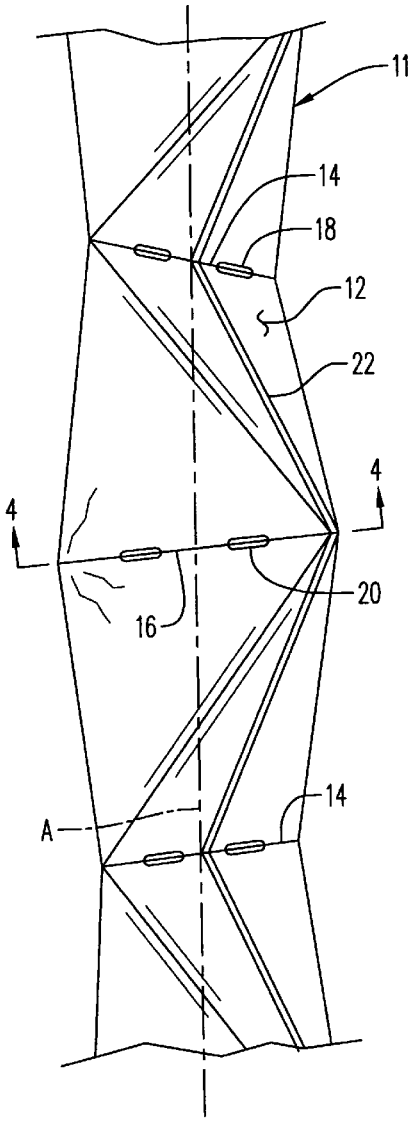
FIG. 2 is an enlarged portion of FIG. 1.

Referring now to the drawings, one embodiment of the invention is shown generally at numeral 10 and is formed of an elongated tubular member 11 made of flexible transparent, translucent or opaque air-tight material such as is used in other inflatable flotation devices for swimming pool play, water safety rescue and inflatable boats and dingys well known in the art. Each end 28 and 30 of the device 10 is sealed having air access in the device 10 only through a closeable valve 32.

This air tight tubular member 10 is typically formed of flexible sheet plastic or vinyl material and the like from an elongated generally rectangular panel folded in half lengthwise and then heat sealed lengthwise along seam 22 and transversely at the ends 28 and 30. Multiple spaced apart folds 14 and 16 are then heat seal formed transversely across the tubular member 11 by attaching in preferably heat sealed fashion opposite points or areas 18 and 20 (typically) of opposing side wall surfaces or areas of the tubular member 11 when deflated and in the flat. By this arrangement, each of the fold lines 14 and 16 are permanently established and maintained by the attachment points 18 and 20 as best seen in FIG. 4 while adjacent portions of each of the fold lines 14 and 16 remain unattached to provide open passageways 24 and 26 (typically) to facilitate uniform inflation and pressurized air balance within the device 10 and within each of the air chambers 12 (typically) defined between adjacent folds 14 and 16.

Figure 4:
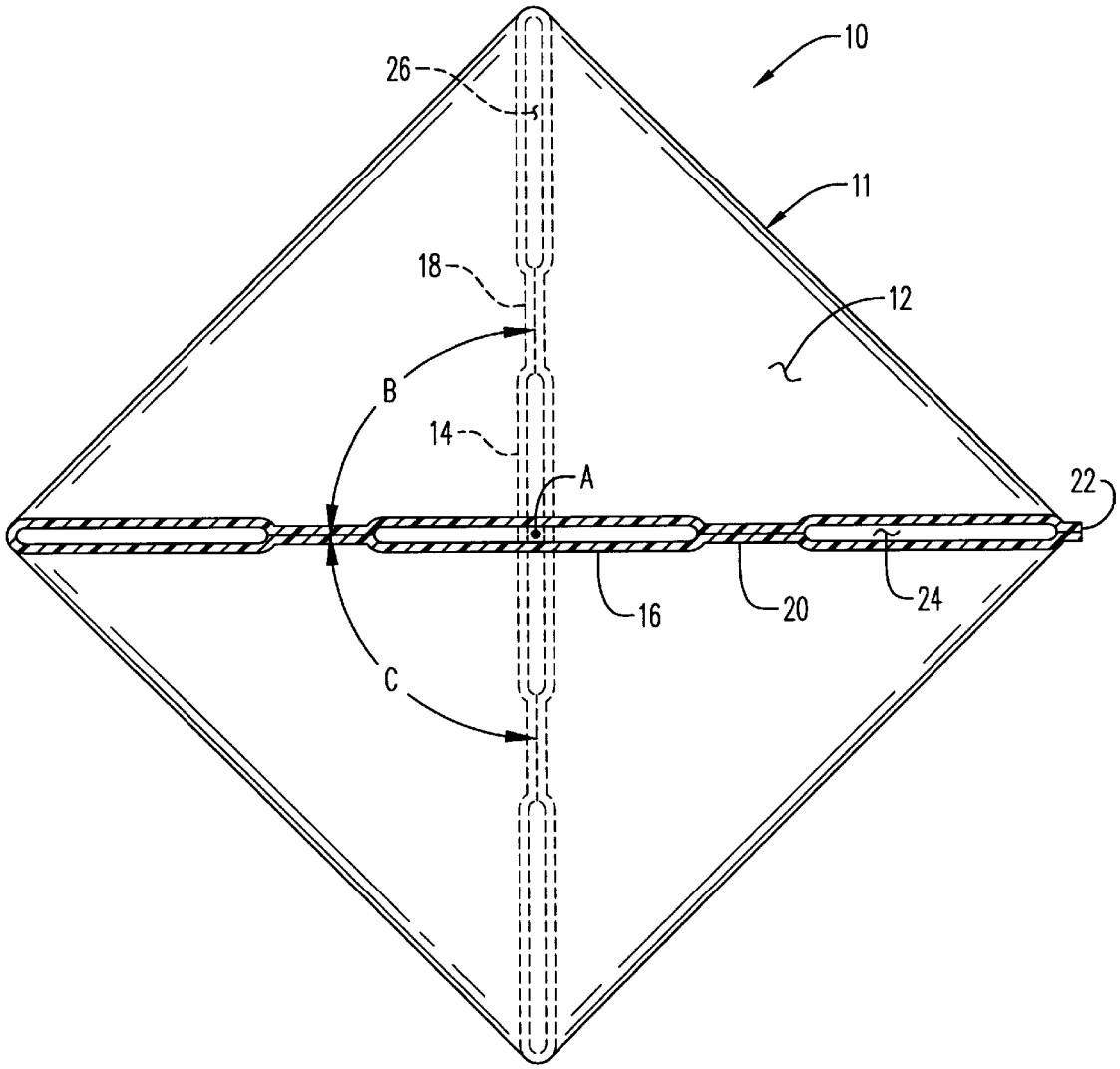
FIG. 4 is a section view in the direction of arrows 4—4 in FIG. 2.

In this embodiment, each successive fold, e.g. 14 followed by 16, is oriented orthogonally to a longitudinal axis A of the device 10 when viewed from the side and orthogonally one to another with respect to the same longitudinal axis A when viewed from the end of the device 10 as in FIG. 4. Thus, each of the air chambers 12 are defined by folds 14 and 16 at each end thereof which are rotationally oriented orthogonally one to another about the longitudinal axis A of the device 10.

Figure 3:
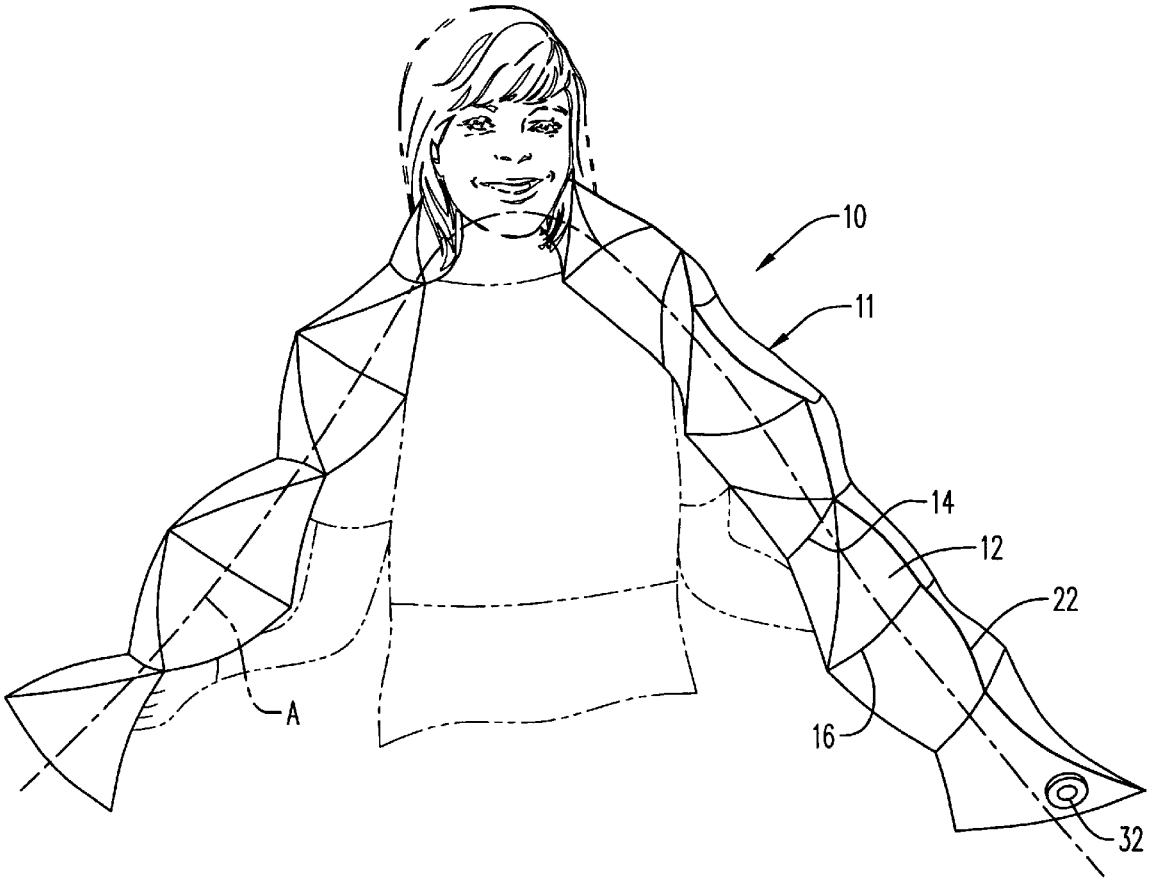
FIG. 3 is a perspective view of the invention of FIG. 1 in use.

By this unique rotational orientation of folds 14 and 16, as best seen in FIG. 3, the device 10, when inflated, is freely bendably compliant to take various complex arcuate configurations such as around the neck and along the length of the arms without exerting any independent force to maintain this selected configuration. Because each of the folds 14 and 16 are freely bendable in hinge fashion, very little if any force is required to simply reposition and reorient the arcuate configuration of the device along its longitudinal axis A. This freely bendable characteristic of the invention eliminates the stressful holding and discomfort of a conventional foam water noodle while in the water such as in support of the neck and shoulders or lower torso of the user when relaxed and floating in water.

Although this embodiment of the invention discloses the fold lines 14 and 16 at an orthogonal or 90° relationship radially at angles B and C with respect to one to another about the longitudinal axis A when viewed from its end as in FIG. 4, other angular orientations, e.g. 45°/135° or any other selected acute/obtuse angle relationship may be utilized within the scope of this invention.

Likewise, although it is preferred to have the folds 14 and 16 alternately oriented orthogonally one to another, two or more consecutive folds may also have a similar angular orientation with respect to the longitudinal axis and likewise the angular orientation may be completely random so long as the folds achieve a differing collective angular orientation one to another along the length of the tubular member 11.

Figure 5:
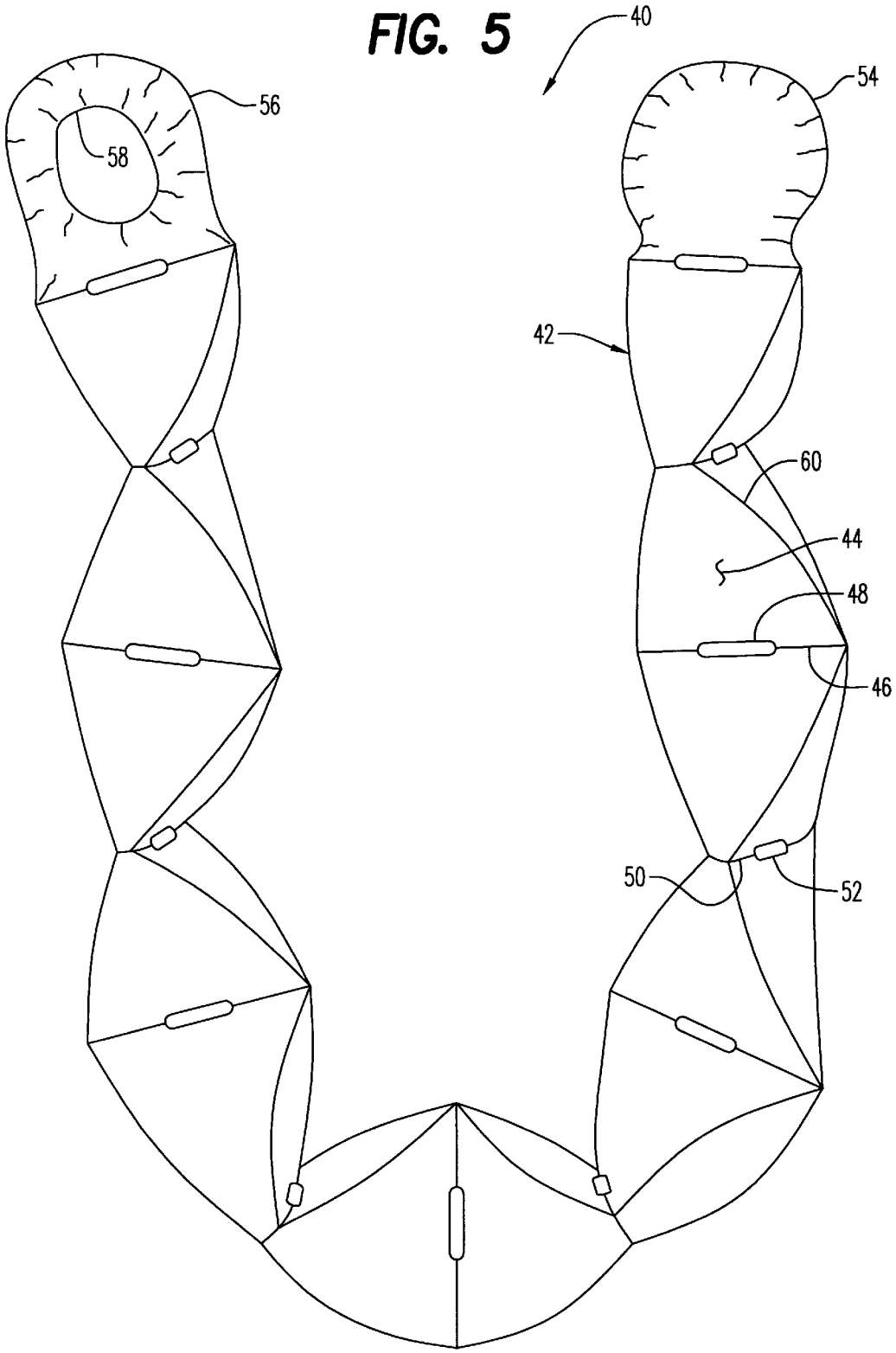
FIG. 5 is a side elevation view of the preferred embodiment of the invention.
Figure 6:
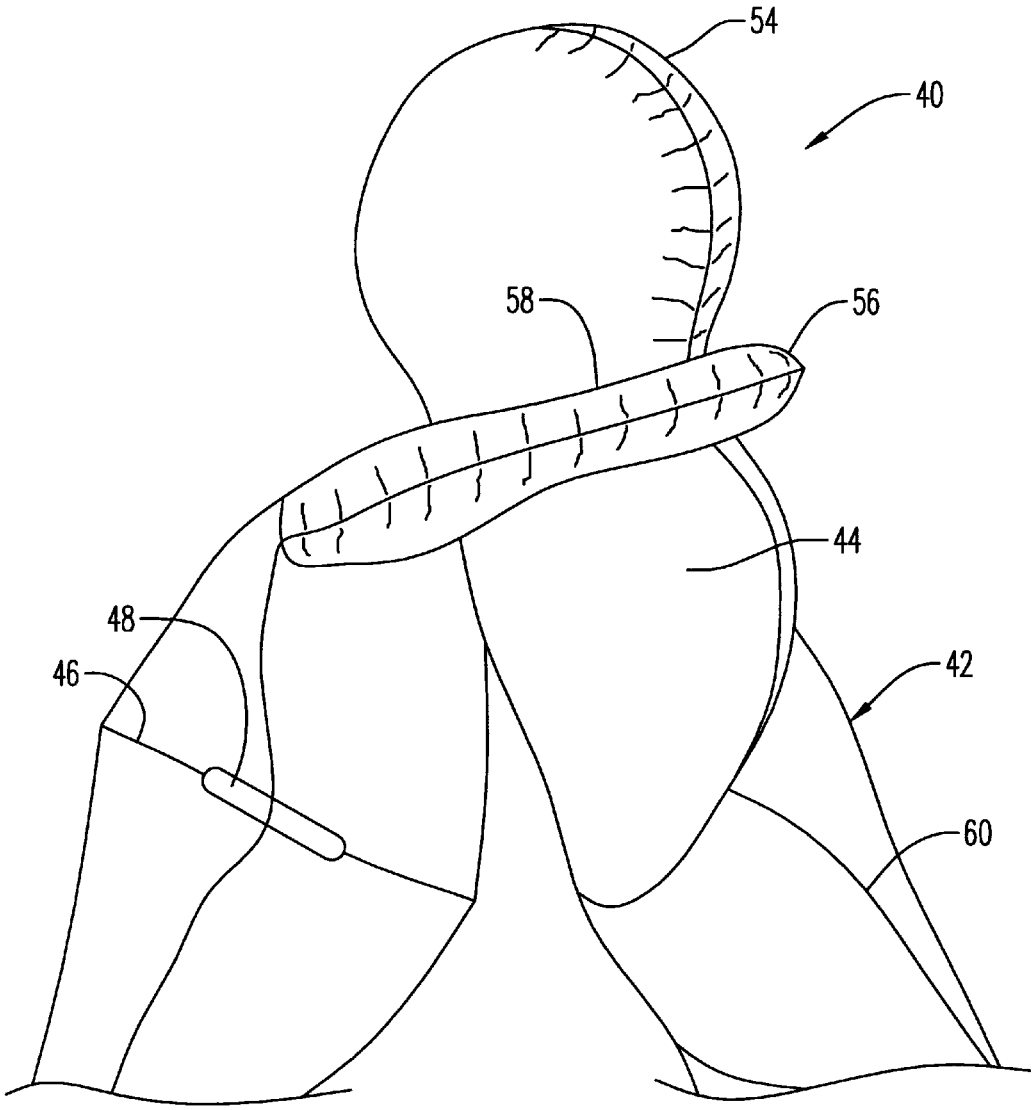
FIG. 6 is an enlarged portion of the upper portion of FIG. 5 showing the ends thereof releasably interconnected.

Referring now to FIGS. 5 and 6, the preferred embodiment of the invention is shown generally at numeral 40 and is also formed of an elongated tubular member shown generally at numeral 11 made of flexible, transparent, translucent or opaque air tight material such as is used in other inflatable toy and flotation devices for swimming pool play and children's toys and the like. This inflatable air tight tubular member 40 is also formed of such materials as flexible sheet plastic or vinyl material and the like from an elongated generally rectangular panel folded in half lengthwise and then heat sealed lengthwise along a seam 60 and transversely across each end 54 and 56. Multiple spaced apart folds 46 and 50 are heat seal formed transversely across the tubular member 11 by attaching in preferably heat sealed fashion the central portion shown typically at 48 of opposing side wall surfaces or areas of the tubular member 11 when deflated and in the flat.

This preferred embodiment 40 has additional end structure in the form of a somewhat flattened spherical end 54 and a looped or ringed end 56 having a central aperture 58 formed therethrough. By this arrangement as best seen in FIG. 6, end 54 is pliably insertable through aperture 58 so as to cause the device 40 to take the generally closed shape of an enlarged flexible flotation ring.

Note that end 56 may be slid over successive air chamber 44 to reduce the overall size of the flexible ring shape that the device 10 has taken and also to produce an elongated end portion terminating in end 54 which affords additional play opportunity.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An elongated inflatable flotation device which is freely bendable when inflated, comprising:

an elongated tubular member sealed at each end thereof to form a sealed inflation air chamber;

spaced apart bendable folds each formed generally transversely across said tubular member by attachment of a side wall of said tubular member along a portion of the length of each said fold thereby allowing air within said tubular member to freely flow past each said fold to balance air pressure within said tubular member during inflation, deflation and bending thereof;

each particular said fold angularly oriented from each said fold adjacent thereto when viewed along a longitudinal axis of said tubular member thereby allowing said flotation device to be freely bent in more than one direction radially about said longitudinal axis.

2. An inflatable flotation device as set forth in claim 1, wherein:

one end portion of said tubular member includes a central aperture formed transversely therethrough;

another end portion of said tubular member is sized to be pliably fitted through and be retained in said central aperture whereby said flotation device becomes ring-shaped.

3. An elongated inflatable flotation device which is freely bendable when inflated, comprising:

an elongated tubular member sealed at each end thereof to form a sealed inflation air chamber;

spaced apart bendable folds each formed generally transversely across said tubular member by attachment of opposite portions of a side wall of said tubular member along a portion of the length of each said fold thereby allowing air within said tubular member to freely flow past each said fold to balance air pressure within said tubular member during inflation, deflation and bending thereof;

each particular said fold orthogonally oriented from each said fold adjacent thereto when viewed along a longitudinal axis of said tubular member thereby allowing said flotation device to be freely bent in more than one direction about said longitudinal axis.

4. An inflatable flotation device as set forth in claim 3, wherein:

one end portion of said tubular member includes a central aperture formed transversely therethrough;

another end portion of said tubular member is sized to be pliably fitted through and be retained in said central aperture whereby said flotation device becomes ring-shaped.

5. An elongated inflatable flotation device which is freely bendable when inflated, comprising:

an elongated tubular member sealed at each end thereof to form a sealed inflation air chamber;

spaced apart bendable folds each formed generally transversely across said tubular member by attachment of opposite areas of a side wall of said tubular member along a portion of the length of each said fold thereby allowing air within said tubular member to freely flow past each said fold to balance air pressure within said tubular member during inflation, deflation and bending thereof;

each particular said fold extending radially across a longitudinal axis of said tubular member and having a varying radial orientation thereby allowing said flotation device, when inflated, to be freely bendable about one or more said folds and, thereby, in multiple directions about said longitudinal axis.

6. An inflatable flotation device as set forth in claim 5, wherein:

one end portion of said tubular member includes a central aperture formed transversely therethrough;

another end portion of said tubular member is sized to be pliably fitted through and be retained in said central aperture whereby said flotation device becomes ring-shaped.

* * * * *